US010208761B2

(12) United States Patent
Weule

(10) Patent No.: US 10,208,761 B2
(45) Date of Patent: Feb. 19, 2019

(54) HOUSING OF A FLUID ENERGY MACHINE

(71) Applicant: Siemens Aktiengesellschaft, Munich (DE)

(72) Inventor: Jan Weule, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 348 days.

(21) Appl. No.: 15/120,009

(22) PCT Filed: Jan. 28, 2015

(86) PCT No.: PCT/EP2015/051640
§ 371 (c)(1),
(2) Date: Aug. 18, 2016

(87) PCT Pub. No.: WO2015/128144
PCT Pub. Date: Sep. 3, 2015

(65) Prior Publication Data

US 2017/0058910 A1 Mar. 2, 2017

(30) Foreign Application Priority Data

Feb. 26, 2014 (DE) ..... 10 2014 203 466

(51) Int. Cl.
*F04D 15/00* (2006.01)
*F04D 27/00* (2006.01)
(Continued)

(52) U.S. Cl.
CPC ..... *F04D 29/083* (2013.01); *F04D 15/0088* (2013.01); *F04D 27/001* (2013.01);
(Continued)

(58) Field of Classification Search
CPC .. F04D 15/0088; F04D 27/001; F04D 29/083; F04D 29/086; F04D 29/102; F04D 29/426; F04D 29/4206; F04D 29/522
See application file for complete search history.

(56) References Cited

U.S. PATENT DOCUMENTS 3,144,035 A * 8/1964 Hablanian ..... B01J 3/006 137/1
3,642,289 A 2/1972 Basham
(Continued)

FOREIGN PATENT DOCUMENTS

CN 103119305 A 5/2013
DE 4011476 A1 10/1991
(Continued)

OTHER PUBLICATIONS

RU Office Action dated Nov. 2, 2017, for RU patent application No. 2016137846.
(Continued)

*Primary Examiner* — Igor Kershteyn
(74) *Attorney, Agent, or Firm* — Beusse Wolter Sanks & Maire

(57) ABSTRACT

A housing of a fluid energy machine which extends along a longitudinal axis, includes a housing casing which extends axially, a housing cover for closing off a housing opening axially on the face side of the housing casing, an annular insert which extends in the housing in a circumferential direction and which bears against the housing casing and against the housing cover, a first seal between the housing cover and the housing casing. To save radial installation space, a second seal is between the housing casing and the annular insert, and a third seal is between the housing cover and the annular insert.

4 Claims, 1 Drawing Sheet

(51) Int. Cl.

| | |
|---|---|
| ***F04D 29/08*** | (2006.01) |
| ***F04D 29/42*** | (2006.01) |
| ***F04D 29/10*** | (2006.01) |
| ***F04D 29/52*** | (2006.01) |

(52) U.S. Cl.
CPC ..... *F04D 29/086* (2013.01); *F04D 29/102* (2013.01); *F04D 29/4206* (2013.01); *F04D 29/426* (2013.01); *F04D 29/522* (2013.01)

(56) References Cited

U.S. PATENT DOCUMENTS

| | | | | |
|---|---|---|---|---|
| 4,413,830 | A * | 11/1983 | Pietsch | B63H 23/321 277/364 |
| 4,457,498 | A * | 7/1984 | Pauliukonis | B21D 24/02 16/DIG. 9 |
| 5,762,342 | A * | 6/1998 | Kakabaker | F16J 15/346 277/306 |
| 2011/0158796 | A1* | 6/2011 | Albrecht | F04D 29/4206 415/206 |
| 2012/0036823 | A1* | 2/2012 | Furman | F23N 5/242 60/39.12 |
| 2012/0146293 | A1* | 6/2012 | Reeb | F16J 15/3236 277/589 |
| 2014/0178182 | A1 | 6/2014 | Huth et al. | |

FOREIGN PATENT DOCUMENTS

| | | | |
|---|---|---|---|
| DE | 4225687 | A1 | 2/1994 |
| DE | 4227249 | A1 | 2/1994 |
| DE | 102011108273 | A1 | 1/2013 |
| DE | 102012223462 | B3 | 8/2013 |
| EP | 0840016 | A2 | 5/1998 |
| FR | 2044199 | A5 | 2/1971 |
| GB | 2242933 | A | 10/1991 |
| JP | S557914 | A | 1/1980 |
| RU | 2140578 | C1 | 10/1999 |

OTHER PUBLICATIONS

IPRP (PCT/IPEA/416), dated Jun. 7, 2016, for PCT application No. PCT/EP2015/051640.

DE Search Report, dated Oct. 8, 2014, for DE application No. 102014203466.3.

International Search Report, dated Apr. 17, 2015, for PCT application No. PCT/EP2015/051640.

CN Office Action dated Mar. 16, 2018, for CN patent application No. 201580010936.5.

* cited by examiner

HOUSING OF A FLUID ENERGY MACHINE

CROSS REFERENCE TO RELATED APPLICATIONS

This application is the US National Stage of International Application No. PCT/EP2015/051640 filed Jan. 28, 2015, and claims the benefit thereof. The International Application claims the benefit of German Application No. DE 102014203466.3 filed Feb. 26, 2014. All of the applications are incorporated by reference herein in their entirety.

FIELD OF INVENTION

The invention relates to a housing of a fluid energy machine, which extends along a longitudinal axis, comprising a housing casing, which extends axially, a housing cover for closing a housing opening at the axial end face of the housing casing, an annular insert, which extends in a circumferential direction in the housing and bears against the housing casing and against the housing cover, and a first seal between the housing cover and the housing casing.

BACKGROUND OF INVENTION

Unless otherwise stated, all directional indications, such as axial, radial and circumferential direction, relate to the longitudinal axis of the housing. In the case of the turbo fluid energy machine, the longitudinal axis is substantially coincident with the axis of rotation of a rotor carrying the individual impellers. An offset of the axis of rotation and of the longitudinal axis of the housing in a turbo fluid energy machine is generally a result of the alignment of the two components in relation to one another.

Such housings are already known from the patent specification DE 10 2012 223 462 B3.

A spiral groove ring corresponding to the annular insert in the preamble of the main claim is already known from DE 42 25 687 A1.

JP 5500 7914 discloses an arrangement with a multistage centrifugal compressor, in which it is provided that liquid accumulating in the return stages can be blown out as and when required by means of injected natural gas. This corresponding blow-out line is led through an end-face cover into an inner housing ring and continued there, seals being provided for the purpose of sealing this routing of the line between the inner housing ring and the cover.

EP 08400016 A2 discloses a turbo machine in which the inflow and outflow are sealed with respect to one another by means of a seal extending in the circumferential direction between an inner housing and an outer housing and end-face opening closures are likewise sealed with respect to the housing by means of static seals. The corresponding inflow and outflow chambers are filled as planned with the process fluid and are not monitored for a leakage.

DE 4011476 A1 discloses a barrel housing pump that has a seal in relation to an end-face cover.

DE 102012223462 B3 is concerned with an arrangement according to the preamble of the invention. A sealing arrangement with a monitored intermediate chamber is provided here between two seals, the two seals being arranged between the housing and an end-face cover. The arrangement is radially encompassing and must be formed such that the radial installation space of the housing wall thickness is not exceeded by the sealing arrangement.

In particular in the area of radial turbo compressors and radial turbo expanders, the use of such housings is customary.

In the context of this patent application, the term "housing casing" means a preferably substantially cylindrical form of housing along a longitudinal axis, which on at least one axial side has a releasably fastened cover and on the other side is either of a closed form—that is to say is in one piece with a closable end-face cover—or likewise has a releasably fastened cover on the axial end face. In particular, the housing has on at least one axial end-face side a lead-through for a shaft, which transfers torques to or from the rotor of a fluid energy machine in relation to the housing according to the invention. This shaft generally has an axis of rotation that coincides substantially with the longitudinal axis of the housing. An application of the invention is in the area of radial fluid energy machines, though an application in the area of axial fluid energy machines is also conceivable in principle.

The invention is specifically concerned with the static sealing of the housing cover in relation to the housing casing by using an additional annular insert. In particular when the compression or expansion of toxic or explosive or in some other way hazardous fluids is involved, reliable sealing of the cover in relation to the housing casing is operationally necessary for reasons of safety.

To register any failure of the seal between the housing casing and the cover, it is known to provide between an interior of the housing with a potentially hazardous process fluid and the surroundings an intermediate space that is monitored for any escape of the process gas in series arrangement z of at least one seal that seals the cover. Advantageously, this intermediate space is also sealed with respect to the surroundings, so that, in the event of the inner seal being defective, no potentially hazardous process gas can escape into the surroundings and monitoring of the intermediate space indicates the necessity for the inner seal to be exchanged.

It is already known from the aforementioned DE 10 2012 223 462 B3 to save radial installation space by providing in addition to a radial offset between an inner seal, which seals the intermediate space in relation to the interior of the machine, and an outer seal, which seals the intermediate space that is monitored in relation to the surroundings, also an axial offset. As a result, the intermediate space is sufficiently large while having a small radial extent, in that the required size of the intermediate space is not only achieved by radial installation space, but also the possibility of axial installation space is utilized.

Nevertheless, the known sealing arrangement requires more radial installation space than is desired.

SUMMARY OF INVENTION

An object of the invention is therefore to develop a sealing arrangement of the type stated at the beginning in such a way that a further saving of radial installation space is possible.

This object is achieved according to the invention by means of a housing of the type stated at the beginning with the additional features of the independent claim. The subclaims, respectively referring back to preceding claims, contain advantageous developments of the invention.

Unless otherwise stated, all directional indications, such as axial, radial and circumferential direction, relate to the longitudinal axis of the housing. In the case of the turbo fluid energy machine, the longitudinal axis is substantially coincident with the axis of rotation of a rotor carrying the individual impellers.

An advantageous development of the invention provides that, sealed by the first seal, the second seal and the third seal, a sealed intermediate space is delimited by the housing casing, the housing cover and the annular insert and this sealed intermediate space is connected to a monitoring line. The monitoring line connects the sealed intermediate space to a monitor, which in the event of the detection of process fluid in the intermediate space sends a signal to a controller, which if appropriate indicates that there is a leak. In the event that the leak has been detected, it is advisable to exchange the defective seal, at least during the next scheduled shutdown of the machine. In the case of a potentially hazardous process fluid, it is advantageous to take the detection of a leakage as a reason to shut the fluid energy machine down directly, and repair the defect immediately, before continued operation.

A circumferential groove for the first seal is expediently provided in the housing cover. A second circumferential groove, for the second seal, is likewise advantageously arranged in the housing cover. These seals may for example be designed as O-ring seals. Another type of seal design is for example a so-called cup seal. In the case of such a type of seal, expansion of the seal takes place when a corresponding differential pressure is applied in the sealing direction. In the case of the so-called cup seal, the bearing force of the seal flanks is dependent on the applied differential pressure over the seal.

A further advantageous development of the invention provides that the insert has a third circumferential groove, in which the third seal is located.

A further advantageous development of the invention provides that the first circumferential groove and/or the second circumferential groove face with their groove opening in the axial direction. A further advantageous development provides that the third circumferential groove for the third seal faces in the radial direction.

The housings of the type according to the invention are in particular used as so-called barrel housings, in which no horizontal parting line of the housing is provided and the housing is closed axially at the end face on at least one axial side by means of a cover. In order for the compressor or expander to function in the desired way, the other axial end face is likewise closed axially at the end face. The housing cover is in this case releasably fastened to the housing casing. A housing cover that is releasably fastened to the housing casing may likewise be provided on the other axial end face. Alternatively, on this axial end face the housing has a one-piece form of the end-closing side of the housing or the housing cover with the housing casing. The housing casing may be formed as a forged component, a welded construction or a cast component, in particular if the housing casing is formed in one piece with the housing cover fastened non-releasably to the housing casing.

A particular form of the invention provides that the insert in the housing casing is a spiral insert of a turbo fluid energy machine and the housing is formed as a barrel volute housing. In the case of this form of the invention, the barrel volute housing and the spiral insert act together in such a way that a collecting channel widening in a volute manner in the circumferential direction as a result of the combination of the two components is obtained for process fluid emerging from an impeller and finally opens out into an outlet stub. This volute collector provides a particularly efficient buildup of pressure of the process fluid emerging from the impeller by being slowed with as little loss as possible.

BRIEF DESCRIPTION OF THE DRAWINGS

The invention is explained in more detail below on the basis of a specific exemplary embodiment with reference to schematic representations, in which.

DETAILED DESCRIPTION OF INVENTION

Figure 1:
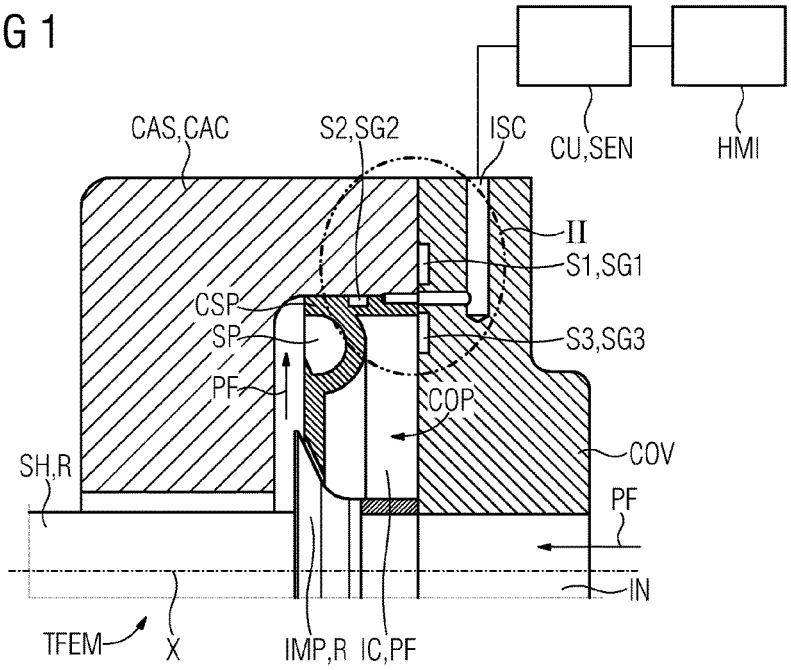
FIG. 1 shows an axial longitudinal section through part of a turbo fluid energy machine.

FIG. 1 shows a schematic representation of an axial longitudinal section of part of a fluid energy machine FEM, here a turbo fluid energy machine TFEM, with a housing CAS, which comprises a housing casing CAC, a housing cover COV and an annular insert CSP. The housing cover COV closes a housing opening COP axially at the end face of the housing casing CAC. In the housing CAS, an impeller IMP of a rotor R is arranged rotatably along an axis of rotation X. Provided on the axial end face of the housing CAS that is facing away from the housing cover COV is an axial opening, through which the rotor R is led out by means of a shaft SH of the rotor R for the transfer of a torque.

The housing cover COV has an inlet opening IN, through which process fluid PF is sucked axially from the impeller IMP, which emerges radially from the impeller IMP and is collected in a volute collector SP of the annular insert CSP before leaving the housing CAS. Substantially the maximum pressure of the process fluid PF prevails in the interior IC of the housing CAS.

Figure 2:
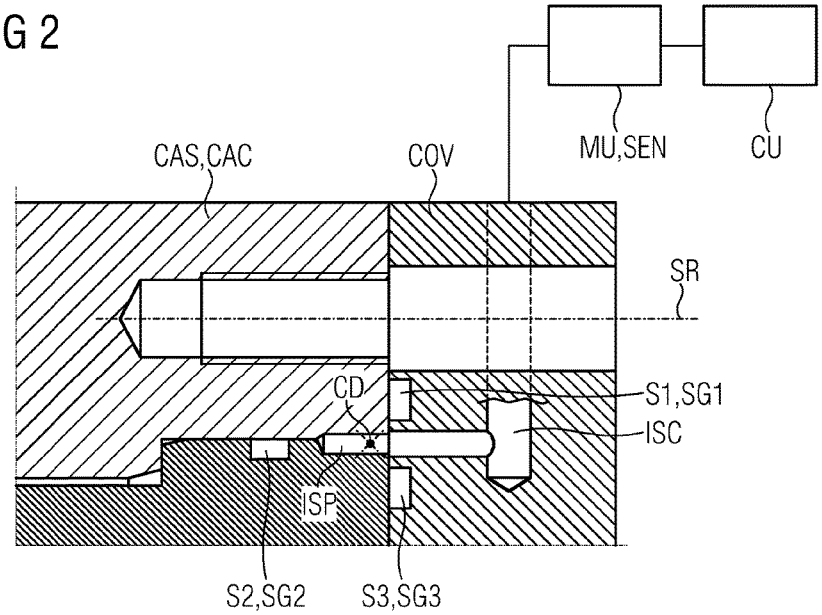
FIG. 2 shows a detailed representation of a cutout from FIG. 1 (indicated there by II).

The sealing arrangement of the housing CAS according to the invention that is represented in detail in FIG. 2 seals this pressure of the process fluid PF with respect to the surroundings.

The annular insert CSP forms together with the housing casing CAC and the housing cover COV an intermediate space ISP extending in the circumferential direction CD. By means of a monitoring line ISC, the intermediate space ISP is connected to a monitoring device MU with sensors SEN. In the event that process fluid PF is detected in the intermediate space ISP, the monitoring device MU passes a signal to a central controller CU, the signal indicating that there is a leakage of the process fluid PF. This leakage is brought to the attention of an operator optically and/or acoustically by means of a commonly used human-machine interface (HMI).

The intermediate space ISP is sealed by means of a first seal S1, a second seal S2 and a third seal S3. Here, the first seal S1, located in a first sealing groove SG1, seals the intermediate space ISP in such a way that an adjacent gap between the housing cover COV and the housing casing CAC is sealed. The second seal S2, arranged in a second sealing groove SG2 of the annular insert CSP, seals an adjacent gap between the housing casing CAC and the annular insert CSP. The third seal S3, which is located in a third sealing groove SG3 of the housing cover COV, seals an adjacent gap between the annular insert CSP and the housing cover COV. In the event of failure of the third seal S3 or the second seal S2, process fluid PF penetrates into the intermediate space ISP, so that the monitoring unit MU detects a leakage. The leakage indicated by means of the central controller CU through indicating instruments HMI calls upon the operator of the machine to exchange the defective seal or to repair the leak.

The arrangement according to the invention makes a radially particularly space-saving construction possible, because the monitored intermediate space ISP has been relocated radially inward from the region that is exclusively between the annular insert CSP and the housing casing CAC. In this way it is possible that the first seal S1 is likewise radially inwardly offset. Consequently, following the first seal in the radially inward direction, the pitch circle for fastening screws SCR for the cover COV on the housing casing CAC can also be chosen to be smaller.

The invention claimed is:

1. A housing of a fluid energy machine, which extends along a longitudinal axis, comprising:

a housing casing, which extends axially, a housing cover for closing a housing opening at the axial end face of the housing casing, an annular insert, which extends in a circumferential direction in the housing and bears against the housing casing and against the housing cover, a first seal between the housing cover and the housing casing, a second seal, between the housing casing and the annular insert, and a third seal between the housing cover and the annular insert, a sealed intermediate space, which is sealed by the first seal, the second seal and the third seal and is delimited by the housing casing, the housing cover and the annular insert, wherein the sealed intermediate space is connected to a monitoring line, which connects the sealed intermediate space to a monitoring unit, which sends a signal to a controller if a process fluid enters the sealed intermediate space from an interior of the housing.

2. The housing as claimed in claim 1, wherein the housing cover comprises a first circumferential groove, in which the first seal is arranged, and wherein the housing cover comprises a third circumferential groove, in which the third seal is arranged.

3. The housing as claimed in claim 2, wherein the annular insert comprises a second circumferential groove, in which the second seal is arranged.

4. The housing as claimed in claim 1, wherein the housing comprises a barrel volute housing, and wherein the annular insert comprises a spiral insert of a turbo fluid energy machine.

* * * * *